United States Patent [19]

Johnson et al.

[11] 4,283,159

[45] Aug. 11, 1981

[54] PROTECTIVE SHROUD FOR OFFSHORE OIL WELLS

[76] Inventors: Albert O. Johnson, Rte. 8, Box 1052, Livingston, Tex. 77351; David Personette, 13307 Barryknoll, Houston, Tex. 77079

[21] Appl. No.: 80,234

[22] Filed: Oct. 1, 1979

[51] Int. Cl.[3] ..... E02B 3/00; E02B 15/04; E02B 17/02; E21B 43/01

[52] U.S. Cl. ..... 405/60; 166/364; 405/203; 405/209; 405/210; 405/211

[58] Field of Search ..... 405/60, 59, 203, 211, 405/204, 205, 210, 209; 166/364

[56] References Cited

U.S. PATENT DOCUMENTS

| | | | |
|---|---|---|---|
| 739,377 | 9/1903 | Bell . | |
| 1,465,664 | 8/1923 | Griesser . | |
| 1,521,088 | 12/1924 | Gignoux . | |
| 1,830,061 | 11/1931 | Howe . | |
| 1,859,606 | 5/1932 | Sievern et al. . | |
| 3,599,434 | 8/1971 | Missud | 405/60 |
| 3,643,741 | 2/1972 | Miranda | 405/60 X |
| 3,667,605 | 6/1972 | Zielinski | 405/60 X |
| 3,681,923 | 8/1972 | Hyde | 405/60 |
| 3,703,207 | 11/1972 | Horton . | |
| 3,719,048 | 3/1973 | Arne | 405/210 X |
| 3,745,773 | 7/1973 | Cunningham | 405/60 |
| 3,866,676 | 2/1975 | Burns . | |
| 3,879,951 | 4/1975 | Mason | 405/60 |
| 3,898,846 | 8/1975 | McCabe | 405/210 |
| 3,964,543 | 6/1976 | Rodgers . | |

*Primary Examiner*—Stephen J. Novosad
*Attorney, Agent, or Firm*—Laurence R. Brown

[57] ABSTRACT

This invention provides means and methods for servicing offshore oil wells under routine and emergency conditions. Thus, a protective shroud surrounding the well site and provided with pumping means can be used to recover spilled oil, store oil, extinguish blowouts and fires, and protect rigs, platforms and personnel.

A hollow shroud structure, preferably of circular cross section surrounding an oil well and its rigging therefore by means of underwater pumps can be positioned, filled, emptied or otherwise manipulated in servicing the well. It serves to protect the well from heavy seas and floating objects.

Servo controlled valves, jets and pumps can locate the structure precisely in place even during blowout conditions for normal or emergency collection of oil and control of the well conditions.

The shroud structure may be erected before or after drilling and can be moved and reused at different sites. It may have a closed top or open top, and a closed top version may be disposed entirely under water.

27 Claims, 7 Drawing Figures

PROTECTIVE SHROUD FOR OFFSHORE OIL WELLS

TECHNICAL FIELD

This invention relates to offshore oil well servicing apparatus and methods. More particularly it relates to oil well servicing apparatus and methods for preventing oil spills in the water from abnormal well conditions, and for recovering and storing oil at the well site by means of a protective shroud placed about the offshore well site.

BACKGROUND ART

Offshore oil wells are difficult to operate safely and under environmentally sound conditions because of hazards involving the underwater situs. Thus, storms through high waves and uncontrollable floating ship, barges, and the like, can cause damage to surface platforms and associated rigging including the well casing which can cause leakage of oil and pollution of the water surface. Also downwell conditions can cause excessive pressures, blowouts and damage to riggings at underwater positions inaccessible and difficult to correct.

The capping and controlling of a runaway underwater well has been difficult, awkward and in some cases unsuccessful, resulting in large areas of water surface pollution by oil and loss of scarce fossil fuels.

Thus, this invention has an objective of improving the state of the art for offshore oil wells to resolve these problems, to prevent oil spill pollution, to recover oil leaking from offshore oil well sites into the water, and to facilitate control and repair of abnormal and damaged well conditions.

There have been prior issued U.S. patents relating to techniques for resolving some of these problems as represented by those briefly discussed hereinafter.

It has been known to provide protective hoods over wellhead sites in both normal and abnormal conditions to receive and recover oil and associated materials flowing from a well. Thus, J. R. Gignous U.S. Pat. No. 1,521,088-Dec. 20, 1924, provides a protecting vented housing structure permanently constructed over an oil wellhead for confinement of the well in case of accident or fire. Also portable protective hoods are known for use in smothering a runaway well and recovering oil therefrom as represented by F. Sieven et al. U.S. Pat. No. 1,859,606-May 24, 1932; F. N. Bell U.S. Pat. No. 739,377-Sept. 22, 1903; and C. S. Howe U.S. Pat. No. 1,830,061-Nov. 3, 1931.

Protective structures are also known for use in offshore locations to surround at least a part of the wellhead site and rigging as represented by E. E. Horton U.S. Pat. No. 3,703,207-Nov. 21, 1972; J. T. Rodgers U.S. Pat. No. 3,964,543-June 22, 1976; and W. Griesser U.S. Pat. No. 1,465,664-Aug. 21, 1923. These structures are erected at the well site both before drilling as in the latter patent and after the drilling is completed and the well is rigged.

Also of some interest is the technique of keeping the wellhead rigging under water as in R. B. Burns U.S. Pat. No. 3,866,676-Feb. 18, 1975.

The present invention has improved this state of the art by providing apparatus and procedures useful at offshore well sites to better facilitate offshore drilling, well servicing, protection from damage and handling of emergency conditions as will be described throughout the following description of the particular advances in the art.

BRIEF DISCLOSURE OF THE INVENTION

This invention provides means confining and storing oil leaking from an offshore well site in a shroud surrounding the well site, preferably in the form of a cylindrical structure from bottom to surface of the body of water in which the well site is located. This protective shroud calms the water about the well and associated rigging and surface platforms and prevents collisions with boats, barges or other floating objects thereby to reduce chance of accidental damage or emergency. Also it serves as a storage tank to recover any leakage of oil or gas from the well and prevent spread of the oil as a pollutant, and provides a means for controlling emergency conditions such as fire or blowout.

The shroud structure is outfitted with pumps for use in locating the structure at the wellhead site and establishing predetermined oil-water levels aiding recovery. The pumps also are used under emergency conditions to put out fires and to process fillers such as mud for smothering a runaway well. Provisions are made to close the shroud top for recovery of natural gas leakage and to produce appropriate pressure and confinement controls for extinguishing fires and counteracting underground pressures, thereby to control runaway wells with or without fires, while containing all the oil seeping into the body of water for useful recovery.

The shroud structure has a set of pumps with adequate pump control means to use the pumps for steering and locating the shroud into position at the wellhead site, either before or after the well is drilled and/or rigged. Thus, the shroud can permit an out-of-water servicing environment when water is pumped out, can serve as a storage tank for the oil, and can under abnormal conditions receive mud or cement for capping a well. The shroud surrounds the surface platform to protect it and resident workers from heavy seas, and thus becomes an improved wellhead servicing aid functioning under the many different conditions that are encountered at offshore well sites to protect the well, the rigging, the personnel and the environment.

Other features, advantages and objectives of the invention will be described in more detail in the following description which refers to the accompanying drawings.

DETAILED DESCRIPTION OF THE PREFERRED EMBODIMENT

Figure 1:
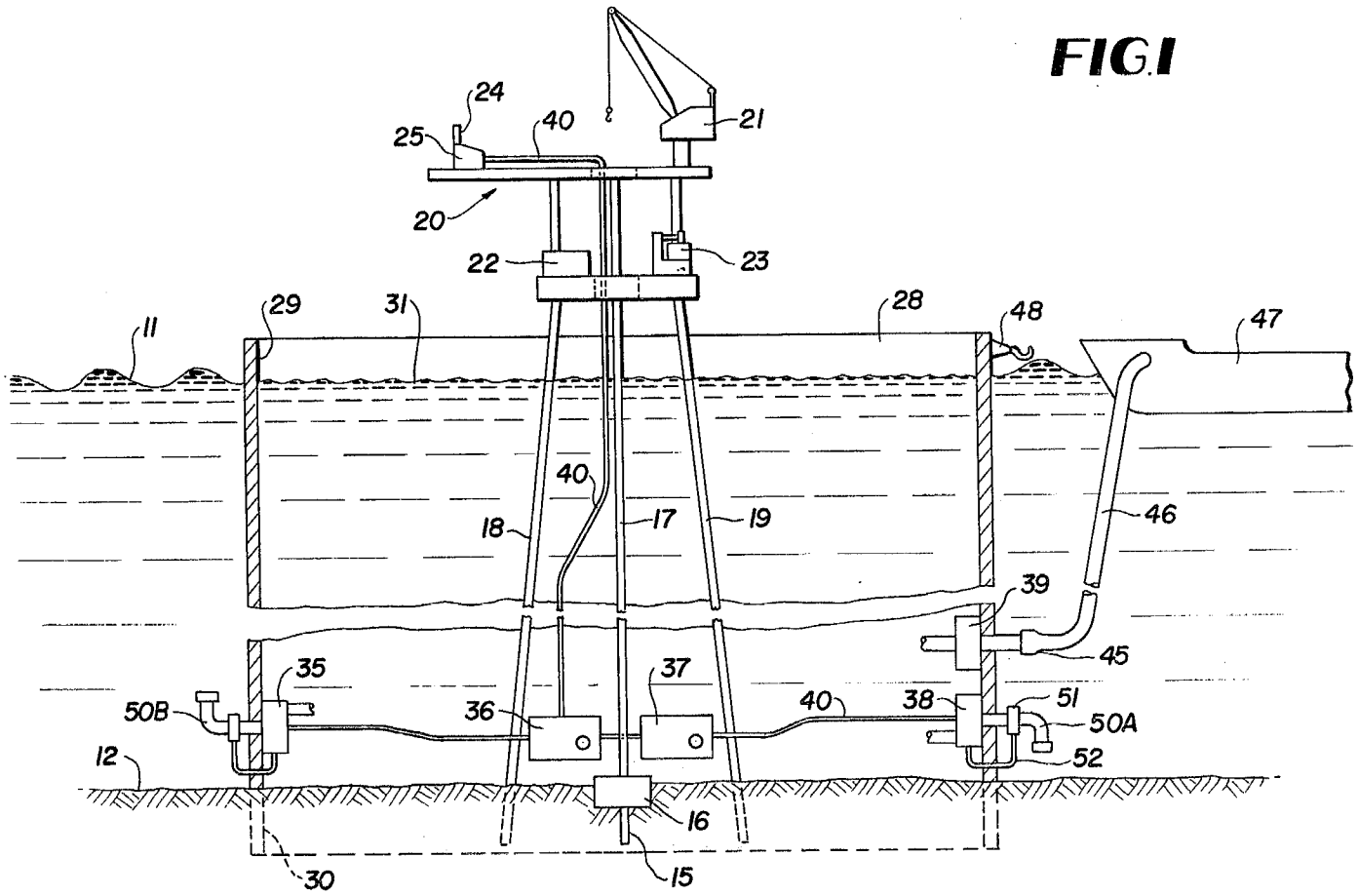
FIG. 1 is a segmental broken away profile elevation view, partly in section and partly in perspective, of the surface and underwater portion of an offshore oil well site constructed and operated in accordance with the teachings of this invention.

Throughout the various views of the drawings like reference characters will be used for equivalent structure to facilitate comparison. A disproportionate scale is used on various features to facilitate showing details in overall perspective system form, thereby producing a simplified visualization of the system combinational features and the improved operating procedures afforded by this invention. It is to be understood that the various preferred embodiments may need be varied to suit conditions and facilities at particular wells and facilities or to meet special operating conditions. The representative offshore oil well facility shown in FIG. 1 illustrates the nature and spirit of both the novel apparatus and operational process features afforded by this invention.

It may be seen that the well site is located in a body of water 10 having a surface 11 and bottom 12. A well bore 15 at the well site terminates in a well head 16 near the bottom 12 of the body of the water, with piping 17 and associated rigging 18, 19 etc. extending upwardly to the platform assembly 20 located above the surface 11 of the body of water. The usual pumping 21, storage 22, and well servicing 23 equipment is placed upon the platform structure together with protective housing (not shown) for operational personnel and a control panel 24 and power source 25 afforded by this invention. The body of water and structure is shown broken away to indicate that the water depth is variable.

In accordance with this invention a surrounding protective shroud 28 is disposed around the well and rigging. The construction of this preferred embodiment represents a cylindrical steel cylinder of about 1 cm ($\frac{3}{8}$ inch) thickness with appropriate vertical bracing (not shown), which may typically have a height of 36.5 meters (120 feet) for use in a water depth of 33.5 meters (110 feet) with the surplus 3 meters (10 feet) being distributed between an upwater breaker wall 29 and a downwater bottom anchor seal provided by that portion 30 buried in the bottom 12. This effects a seal retarding passage of water from the body 10 into the interior of the cylinder 28, so that the water level inside the cylinder 28 may be controlled by means of pumps passing liquids through the cylinder walls as hereinafter discussed. Note that the surface 31 of the water body inside the cylinder is smoother so that the shroud serves to protect the rigging against waves and storms and therefore reduces the risk of accident and damage.

A typical diameter for surrounding a well site is about 90 meters (300 feet). This results in stable footing and height dimensions which prevent the surface wave and/or wind action even in the presence of squalls or storms from moving or dislodging the structure when it is positioned and held in place only by its own weight. There can, of course, be equivalent shroud wall structure of poured concrete or the like or even a ring of pilings should the water depth be shallow.

As may be seen from FIG. 1, the cylinder 28 at a position near the bottom 12 has located about is circumference a plurality of pumps 35 to 39 disposed at two different vertical levels. These pumps are preferably bidirectional to pump water into and out of the region inside the cylinder 28 through the cylindrical structure walls that otherwise keep water from such flow.

The pumps 35 to 39 are controlled individually from surface power at station 25 which is selectively conveyed by means of a control panel 24 through control lines 40 to produce versatile functions used in various aspects of wellhead servicing to be described. This power and control system could be typically electrical or hydraulic. In any event the pumps are individually controlled from the surface without requiring divers or underwater manual controls.

Thus, typically six or eight pumps 35–38 are disposed circumferentially about the bottom of the cylinder 28 each with a pumping capacity of about 5700 liters (1500 gallons) per minute through 10 cm (4 inch) diameter pipes. One or more similar pumps 39 are disposed at one or more upper tier levels.

Each pipe extending through the cylinder 28 from the corresponding pump has a quick disconnect fitting 45 so that a hose or other conveyance line 46 may be selectively attached to one or more pumps for transporting liquid or semi-liquid materials to and from the surface 11 such as to the barge or ship 47. There may be hooks for retaining lines and docking implements at the surface outer periphery of the cylinder 28 as indicated at 48.

The pumps 35–38 are fitted with elbow type fittings 50 external to the cylinder 28 which rotate on a rotatable coupling 51 operable from the surface by a servo mechanism or the like as indicated by control line 52 which emanates from control cabling 40. The elbow 50 comprises pipe openings 10 to 15 cm (4 to 6 inches) in diameter, which perform as nozzles or jets when water is pumped from inside cylinder 28 out by pumps 38, etc. into the body of water 10 from the elbows 50. By rotating the nozzles then a jet motive power tending to rotate and/or laterally move the cylinder, raise it, or lower it may be selected by the positioning of the elbow with the L-shaped extension being substantially parallel with the tangent to cylinder 28.

It is readily seen therefore that in initial placement of the cylinder over a well site that the cylinder may be manipulated by the control panel 24 to move in any direction, tilt slightly, raise or lower the cylinder by selective control of the pumps and jets. Thus, if the elbow jets 50 are pointed downwardly as in the case of 50A the cylinder would be raised and kept off the bottom for lateral movement which could come for example from selective operation of the upper tier pumps 39 on one side only of the cylinder, or by manipulation of direction and tilt of the cylinder with the six or eight pumps 35–38 and their nozzle inclinations. Conversely the elbow jets 50 when upwardly oriented as 50B can be used to aid gravity weight in lowering the cylinder forcefully into the bottom 12 to anchor it and effect a water seal about the lower opening of the cylinder 28.

If the cylinder is held off the bottom to locate it, then the water level will rise to an interior surface level 31 determined by the surface level 11 exterior to the cylinder. The cylinder 28 may be placed at the well site before drilling if desired and in this case the pumps 35–39 may be used to pump the internal water out so that the drilling operations can be effected more efficiently in the conventional manner without employing underwater techniques.

Conversely the cylinder may be placed about an existing offshore well site with rigging and platform by building in place with vertical segments or halves or by layering from bottom up as in the case of poured concrete. Note, however, the platform and rigging cost may be considerably reduced if the shroud is put in place before the well is drilled and the rigging and platform are erected within the protective environment of the shroud, since the maximum expected forces inside cylinder 28 are reduced and the rigging and platforms need not be as rugged as to withstand all the forces of open seas.

For achieving recovery of oil spilled from the well head by accident, even with a blowout and fire condition the protective shroud and pump arrangement is important. The pumps 35–38 on the lower tier may pump out water to a level that oil is accessible floating on the water at the second tier pump(s) 39 for pumping into storage transport vessel 47.

For a fire on platform 20, the pumps 39, etc. can be used for spray to control the fire.

For putting out fires or blowouts, mud or cement may be pumped into the cylinder by way of hose 46 and pump(s) 39.

Figure 2:
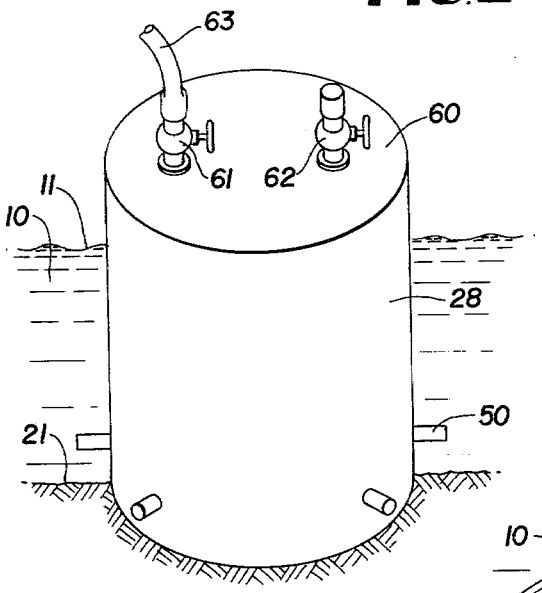
FIG. 2 is a perspective sketch of an offshore well site shroud structure embodiment afforded by the invention in place at the wellhead.

When counter pressure forces are necessary or it is desirable to recover natural gases, the covered embodiment of FIG. 2 may be used. Thus, a closed top 60 is provided with valves 61, 62 to control openings. Thus, the top may be freely vented, closed to collect gas or induce pressure inside cylinder 28 or regulated to flow out gas through conveyance line 63 under control of valve 61.

Accordingly, with valves 61 and 62 closed a counter internal pressure is created within cylinder 28 offsetting the oil pressure at the wellhead thereby tending to smother or restrict the oil flow coming from down well pressures.

With a leaking well, natural gas now may accumulate within the cylinder 28 and valves 61, etc. will permit recovery at a predetermined rate in conveyance line 63.

Figure 3:
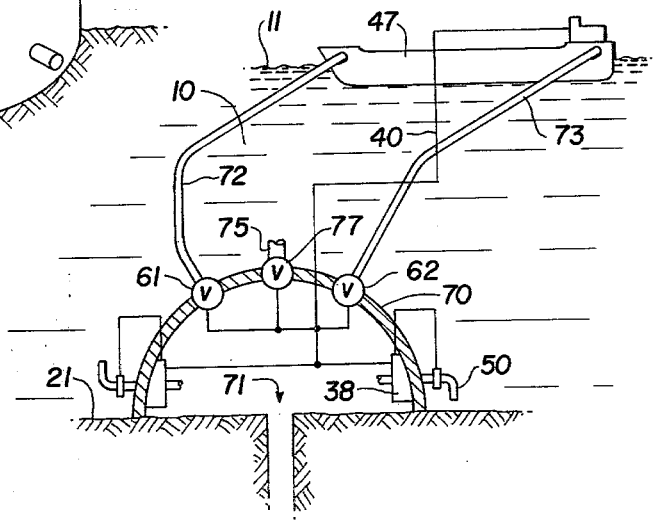
FIG. 3 is an elevation section view of a shroud structure embodiment afforded by this invention as used to control and contain runaway underwater oil wells.

For the purpose of smothering an underwater blowout, the same techniques can be used for location of a large cylindrical structure over the blowout as hereinbefore described. However, a smaller structure may be used in terms of the underwater cap 70 shown in FIG. 3, where well 15 has a blowout condition 71 which has destroyed the rigging and is leaking at the bottom 21 of the body of water 10. Underwater mobility may be aided by trapping air in the structure for buoyancy and controlling release through the valves 61, 62 and 75 to seat the structure in place on the bottom 21.

In this case the valves 61 and 62 are servo controlled from the surface at barge or ship 47 by means of control lines 40 as is a central vent valve 75. Mud or cement may be pumped within the cap 70 by means of conveyance lines 72, 73.

Failure to cap underwater blowouts heretofore have resulted because a cap could not be maneuvered into position directly over a blowout and lowered into sealing position with the bottom.

In the case of this invention, the use of pumps 38, etc. and nozzles 50, etc. will permit appropriate positioning from the surface in the manner aforesaid. Also vent 75 is left open until after the cap is anchored so that the well blowout pressures will not prevent the cap from seating and sealing at the bottom. After control of the wellhead, oil may be taken out along lines 72, 73 by means of valves 61, 62. To assume control and smothering, the vent valve 77 is closed after the cap 70 is firmly seated and anchored on the bottom 21, thereby smothering the blowout and extinguishing any fire.

Figure 4A:
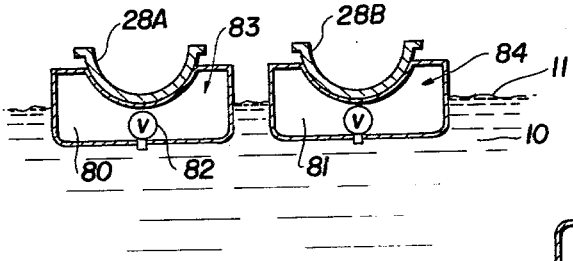
FIGS. 4A and 4B are sketches showing the transport and assembly of the shroud structure on the surface of the body of water at the offshore well site.
Figure 4B:
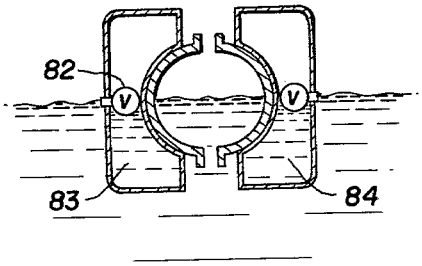

One preferred means of assembling a cylinder as shown in FIG. 1 on situs, is typified in FIGS. 4A and 4B where two halves 28A, 28B of the cylinder 28A are transported to the site by barges 80, 81. By means of proper balance and longitudinal bulkheads 82 (shown in the barge end views of FIG. 4), the barge holds 83, 84 may be filled with water and tilted to bolt together flanges on the semi-cylinders 28A and 28B.

Also, in a similar manner the barges may be longitudinally tilted to let the cylinder or a half cylinder slide downwardly into close proximity to the situs desired.

Figure 5:
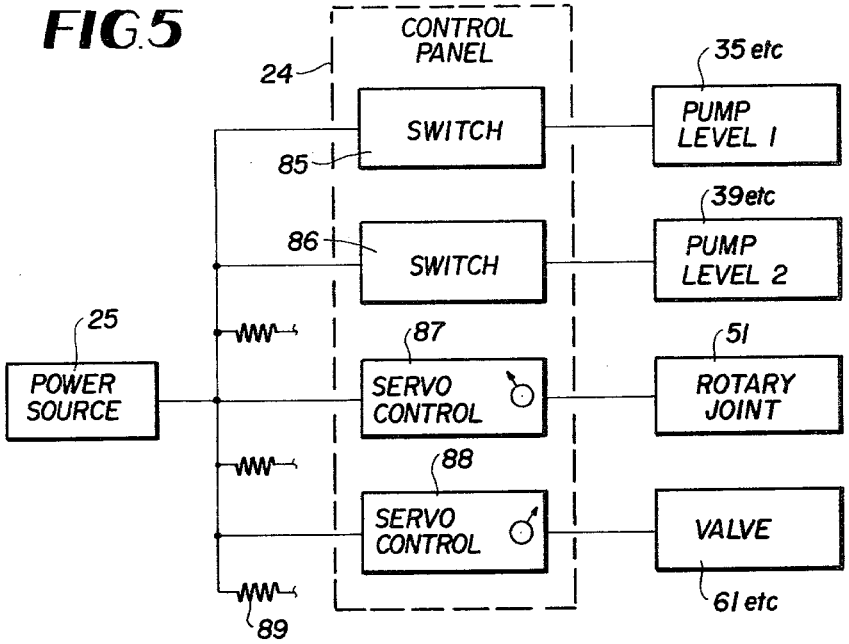
FIG. 5 is a block diagram of the control circuits for operation of the mechanisms provided on the shroud in accordance with this invention for the various modes of operation in servicing a wellhead site under normal and abnormal conditions.

The controls for the various pumps and servos are shown in block diagram in FIG. 5. Thus the individual switch and servo controls 85–88 may be used to individually control corresponding pumps, valves and joints. The notation 89 indicates that similar controls may be duplicated for each pump, valve, etc. element needing individual control.

Figure 6:
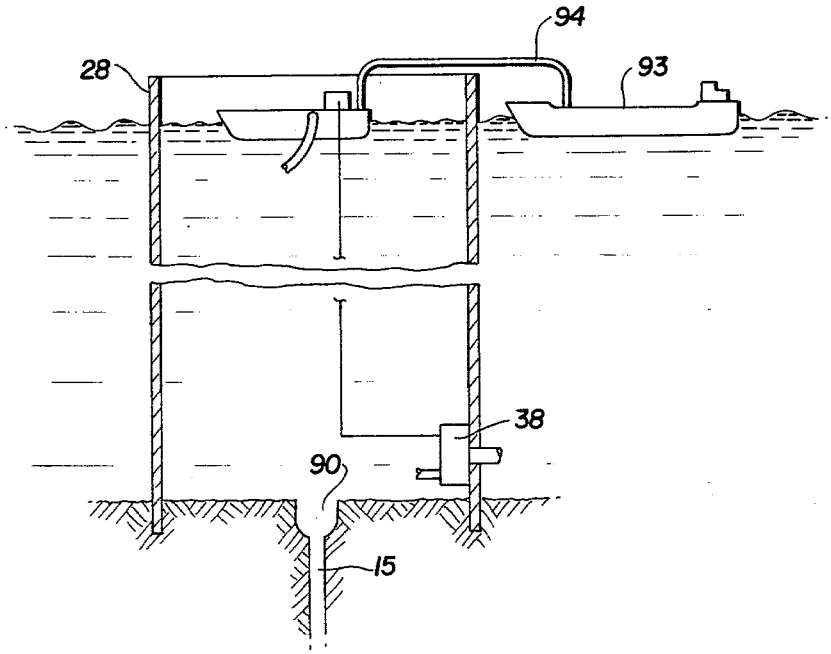
FIG. 6 is an elevation section view, partly broken away, of a simplified undersea oil well structure provided in accordance with this invention.

As seen in FIG. 6, the improvements of this invention permit a simplified offshore wellhead rigging. Thus, the cylinder 28 simply serves as a well service center for receiving and storing oil produced from well bore 15. A wellhead control center 90 may comprise a pump, or a free flowing well depending upon the downhole performance. Thus, a barge or the like can provide surface power and controls and can have pumps for filling tankers 93 by way of conveyance line 94.

The aforesaid pumps 38, etc. can be used for pumping in water to keep available oil at the surface level 11 of the body of water.

It is therefore clear that this invention has advanced the state of the art with novel apparatus and procedures for servicing offshore oil well sites. Thus, those features of novelty believed descriptive of the spirit and nature of the invention are defined with particularity in the appended claims.

INDUSTRIAL APPLICATION

A protective shroud is used on situs at an offshore oil well to protect and service the well under normal and abnormal conditions. Thus, leaks, blowouts and fires may be handled without loss of oil or pollution of the water surface, greater oil storage capacity is provided and conventional offshore rigging may be simplified.

What is claimed is:

1. An oil rig instrumentality comprising a protective shroud member comprising a generally cylindrically shaped structure of a length sufficient to extend from the bottom of a body of water and out of the water at the surface, and of sufficient diameter to encompass an oil wellhead and attendant rigging servicing an underwater well, said structure having near its bottom in a position assuming an underwater location above and near the bottom of said body of water a plurality of pumping means distributed about the circumference of said structure for pumping liquids with said pumps coupled to water jet structure outside the cylinder, and including control means individually controlling operation of each of said pumping means, thereby to provide controlled water jet motive forces for moving said structure relative to said bottom of the body of water.

2. An instrumentality as defined in claim 1, including L-shaped jet nozzle means coupled to said pumps and extending with one arm generally parallel the tangent to the cylinder, and rotary coupling structure permitting orientation of the nozzles to select the direction of the motive forces relative to said structure.

3. An oil rig instrumentality comprising a protective shroud member comprising a generally cylindrically shaped structure of a length sufficient to extend from the bottom of a body of water and out of the water at the surface, and of sufficient diameter to encompass an oil wellhead and attendant rigging servicing an underwater well, said structure having near its bottom in a position assuming an underwater location above and near the bottom of said body of water a plurality of pumping means distributed about the circumference of said structure for pumping liquids wherein said pumping means comprise pumps for pumping liquids outwardly from the structure located at two different levels respectively at significantly different heights from the bottom of said body of water and separate pump control means to independently pump liquids out from within said structure at the two different levels.

4. An instrumentality as defined in claim 3 wherein the pumping means has extending conduit means with quick coupling fixtures located at the outer surfaces of the structure to permit connection with liquid conveyance hoses.

5. An instrumentality for servicing an underwater oil well comprising in combination, an open bottomed hollow structure of sufficient size to surround the wellhead of said oil well and any rigging connected with said oil well and having sufficient weight to rest and seal with a substantially water flow free joint on the bottom of a body of water about said open bottom in a position surrounding said wellhead thereby to confine the well site within its hollow structure, and liquid pumping means distributed about the structure including jets for positioning the structure on the bottom of said body of water to register in position with said wellhead by means of liquids pumped from said structure through said jets.

6. An instrumentality as defined in claim 5 including means connecting conveyance tubes to said jets to transport liquids pumped out of said structure by said pumping means.

7. An instrumentality as defined in claim 5 wherein said hollow structure has an open top that extends above the water in said body of water, thereby to protect the rigging from collision with water carried objects and providing a quieted water surface around the rigging.

8. An instrumentality as defined in claim 5 wherein said hollow structure has a closed top with valves therein for release of gases and liquids from the hollow body.

9. An instrumentality as defined in claim 8 wherein the height of said structure places the closed top below the surface of the water.

10. An instrumentality as defined in claim 5 wherein the structure has a substantially circular cross section including a plurality of pumping means distributed about the circumference of said cross section and control means for selectively actuating said pumps individually thereby to control the lateral movement of said structure through said body of water.

11. An instrumentality as defined in claim 5 wherein the structure has sufficient weight and a bottom contour of such shape to engage the bottom of the body of water in a substantially flow free joint preventing water from said body from flowing freely through the joint into the structure.

12. The method of servicing an underwater oil well comprising the steps of, positioning at an oil well site a hollow structure having an underwater opening adapted to engage the bottom of a body of water and of such weight that it resides firmly on the bottom of said body of water to make a seal substantially preventing flow of water from the body into the structure, and manipulating the position of the structure at the oil well site to position the structure in place on the bottom surrounding the oil well site by passing liquid jets through said structure.

13. The method defined in claim 12 including the step of closing the top of said structure with selectively operable closures including valves enabling the structure to trap therein air for buoyancy, and controlling the valves to release trapped air while positioning the structure on the bottom.

14. The method defined in claim 12 including the step of positioning said structure to surround an oil well site before drilling a well.

15. The method defined in claim 14 including the steps of keeping water out of said structure, rigging the well within said structure while without water and letting water substantially fill said structure after the well is rigged.

16. The method defined in claim 12 including the step of assembling the hollow structure on situs about a well and well rig existing at the well site.

17. The method defined in claim 16 wherein the structure is substantially cylindrical where the positioning step includes the steps of transporting two semi-cylindrical halves of the structure to the well site by barge and joining the two semi-cylindrical halves to form the structure on situs.

18. The method defined in claim 12 including the step of pumping water out of said structure selectively from various positions about the structure to position it laterally at the well site position for registration with the wellhead.

19. The method as defined in claim 12 including the steps of accumulating oil from the well inside said structure, and selectively pumping oil out of said structure to a storage facility.

20. The method as defined in claim 12 wherein the structure extends from the bottom to a position above the surface of a body of water, including further steps for servicing abnormal well conditions when the well is leaking oil into the structure comprising, permitting the water within the structure to reach a predetermined level, gathering the leaking oil within said structure as a temporary storage tank by accumulation on the surface of the water within the structure, pumping out water from the structure selectively as oil leaks in to provide additional storage capacity, and pumping the oil from the structure to recover it.

21. The method as defined in claim 12 wherein the structure extends from the bottom to a position above the surface of a body of water, including further steps for servicing abnormal well conditions for recovery of leaking gaseous vapors comprising, selectively covering the structure above the water to control egress of gaseous residue within the structure, and recovering gases accumulated in the structure above the water by passing out of the cover into a transport line.

22. The method of claim 12 with additional steps for controlling oil wells leaking from a well position near the bottom of the body of water comprising, selectively closing the top of said hollow structure to produce an internal pressure counteracting the well pressure to retard the rate of leakage of oil, and selectively recovering oil from within the hollow structure at a predetermined flow rate.

23. The method of claim 12 with additional steps for controlling a runaway oil well at the bottom of a body of water comprising, maintaining the top up-water side of said hollow structure open while locating the structure in registration at the wellhead and sealing it in position with a substantially flow free joint at the bottom of the body of water, and thereafter selectively controlling a closure at the top of the structure to restrict flow of discharge from the well into the structure.

24. The method of claim 23 wherein the last step is achieved by means of selectively operable valve structure in the top of said structure, including the step of transporting by conveyance lines attached to the valve structure a flow of oil from the wellhead.

25. The method of claim 12 for controlling runaway oil wells having a leaking wellhead at the bottom of a body of water wherein the structure comprises a closeable top with control valves therein permitting selective flow of materials through the top, including the step of placing the structure in place over the wellhead to effect a sealing joint with the bottom of the body of water with the control valves open to permit free flow of discharge from the wellhead through the dome structure as the dome is being seated on the bottom, and thereafter selectively controlling the valves to restrict the flow of oil through the dome.

26. The method of claim 25 wherein the structure includes conveyance structure coupled thereto for removing and recovering oil from inside the structure, including the step of diverting flow of oil in the structure to flow through said conveyance structure.

27. The method of claim 25 including the step of pumping a material such as mud into the structure after it is in place above the wellhead to settle about the wellhead and block flow of oil therefrom.

* * * * *